US006445891B2

(12) United States Patent
Shiraishi

(10) Patent No.: US 6,445,891 B2
(45) Date of Patent: Sep. 3, 2002

(54) IMAGE FORMING APPARATUS CAPABLE OF BEING FITTED WITH OFFSET STACKER, COPYING MACHINE EQUIPPED WITH THE IMAGE FORMING APPARATUS, AND METHOD OF CONTROLLING THE IMAGE FORMING APPARATUS

(75) Inventor: Hiroyuki Shiraishi, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/852,943

(22) Filed: May 10, 2001

(30) Foreign Application Priority Data

May 17, 2000 (JP) ..... 2000-145227

(51) Int. Cl.[7] ..... G03G 15/00

(52) U.S. Cl. ..... 399/82; 271/265.01; 271/288; 399/404

(58) Field of Search ..... 399/16, 18, 43, 399/81, 82, 404; 271/207, 288, 184, 225, 265.01

(56) References Cited

U.S. PATENT DOCUMENTS

| | | | | |
|---|---|---|---|---|
| 4,635,920 A | | 1/1987 | Kodama | |
| 5,447,297 A | * | 9/1995 | Murata et al. | 270/58.09 |
| 5,951,008 A | * | 9/1999 | Williams et al. | 271/288 |

* cited by examiner

*Primary Examiner*—Sophia S. Chen
(74) *Attorney, Agent, or Firm*—Frishauf, Holtz, Goodman & Chick, P.C.

(57) ABSTRACT

The CPU detects an error in the timing of offset stacking by the offset stacker on the basis of the time when the offset motor signal for driving the offset motor is generated and the time when the initial position sensor is turned ON. Upon detecting an error in the timing of offset stacking, the CPU forces the image formation by the image forming unit and the paper transportation by the paper transporting motor to stop, thus preventing paper from being introduced into the offset stacker.

16 Claims, 6 Drawing Sheets

IMAGE FORMING APPARATUS CAPABLE OF BEING FITTED WITH OFFSET STACKER, COPYING MACHINE EQUIPPED WITH THE IMAGE FORMING APPARATUS, AND METHOD OF CONTROLLING THE IMAGE FORMING APPARATUS

CROSS-REFERENCE TO RELATED APPLICATIONS

This application is based upon and claims the benefit of priority from the prior Japanese Patent Application No. 2000-145227, filed May 17, 2000, the entire contents of which are incorporated herein by reference.

BACKGROUND OF THE INVENTION

1. Field of the Invention

The present invention relates to an image forming apparatus which can be fitted with an offset stacker that allows image-formed sheets of paper to be offset stacked in the discharge tray, a copying machine equipped with the image forming apparatus, and a method of controlling the image forming apparatus.

2. Description of the Background Art

The offset stacker is one of the stacking devices that can be fitted to the paper discharge section of an image forming apparatus. The offset stacker allows finished sheets to be offset stacked in the discharge tray for automatic sorting thereof. Thus, the sheets cannot be sorted normally unless a predetermined relationship is maintained between the discharge timing and the offset timing.

However, the discharge timing and the offset timing can be displaced relative to each other due to failures or malfunctions. In that event, the sheets are discharged to wrong positions on the discharge tray and the user may suppose that the sheets are being sorted correctly without noticing wrong discharge to the discharge tray.

To date, various types of offset stackers have been developed. Among them is one that has offset discharge rollers. This type of offset stacker is equipped with a mechanism for moving the discharge rollers adapted to discharge finished copies to the discharge tray in a direction perpendicular -to the direction of paper transportation. By moving the discharge rollers with the paper pinched, the places where copies fall into the discharge tray are offset.

With such an offset stacker, the displacement of the discharge timing and the offset timing may disturb the paper transportation, resulting in a paper jam.

At the occurrence of a paper jam, the user has to remove the jammed paper, which imposes an extra burden on the user and may also damage the machine.

Where the image forming apparatus is of an electrophotographic type, the operation of the thermal fixing equipment has to be stopped in the event of a paper jam, which requires an appreciable amount of time to restart the image forming operation after removal of the jammed paper.

BRIEF SUMMARY OF THE INVENTION

It is an object of the present invention to prevent improper paper discharge when a malfunction occurs in the offset stacker.

The object is attained by an image forming apparatus which forms an image on a predetermined paper form transported by a paper transport mechanism on a predetermined paper path using image forming means and can be fitted with an offset stacker which, in discharging paper forms after being formed with images into a discharge tray, offset stacking the image-formed paper forms in the discharge tray, comprising error detection means for detecting an error in the timing of offset stacking by the offset stacker; and forced stopping means responsive to the error detection means for forcing the paper transport mechanism and the image forming means to stop their operation when an error is detected by the error detection means.

Moreover, the object is attained by a copying machine which includes an image scanner for scanning an image on each of the originals and an image forming apparatus for forming an image scan by the image scanner on a paper form transported by paper transport means on a predetermined paper path using image forming means and can be fitted with an offset stacker which, in discharging paper forms after being formed with images into a discharge tray, offset stacking the image-formed paper forms in the discharge tray, comprising error detection means for detecting an error in the timing of offset stacking by the offset stacker; and forced stopping means responsive to the error detection means for forcing the paper transport means and the image forming means to stop their operation when an error is detected by the error detection means.

Furthermore, the object is attained by a method of controlling an image forming apparatus which forms an image on a predetermined paper form transported by a paper transport mechanism on a predetermined paper path using image forming means and can be fitted with an offset stacker which, in discharging paper forms after being formed with images into a discharge tray, offset stacking the image-formed paper forms in the discharge tray, comprising the steps of detecting an error in the timing of offset stacking by the offset stacker; and forcing the paper transport mechanism and the image forming means to stop their operation when an error in the timing of offset stacking is detected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

There will now be described embodiment of this invention with reference to the accompanying drawings.

Figure 1:
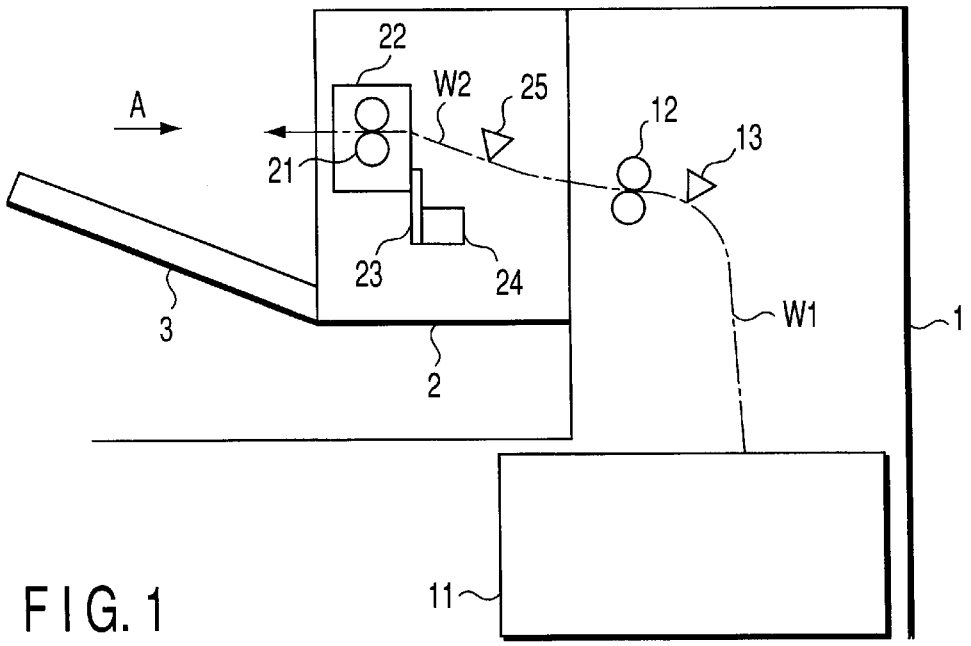
FIG. 1 is a schematic representation of a digital copying machine embodying the present invention.
Figure 2A:
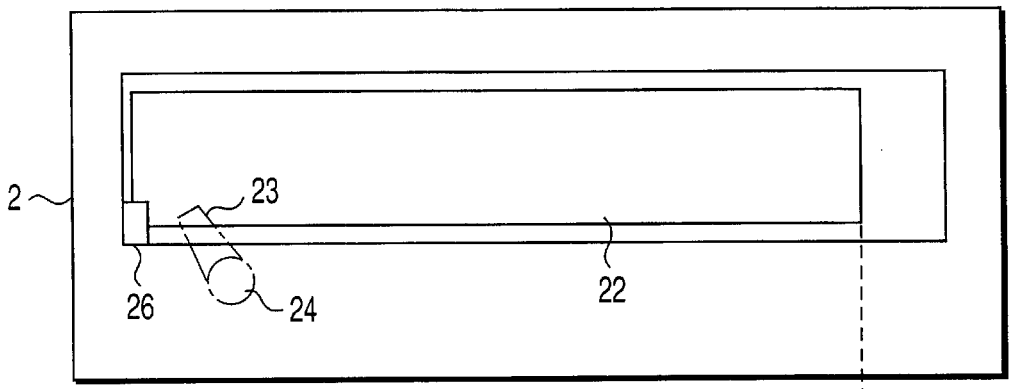
FIGS. 2A and 2B are views of the offset stacker in the direction of arrow A in FIG. 1.
Figure 2B:
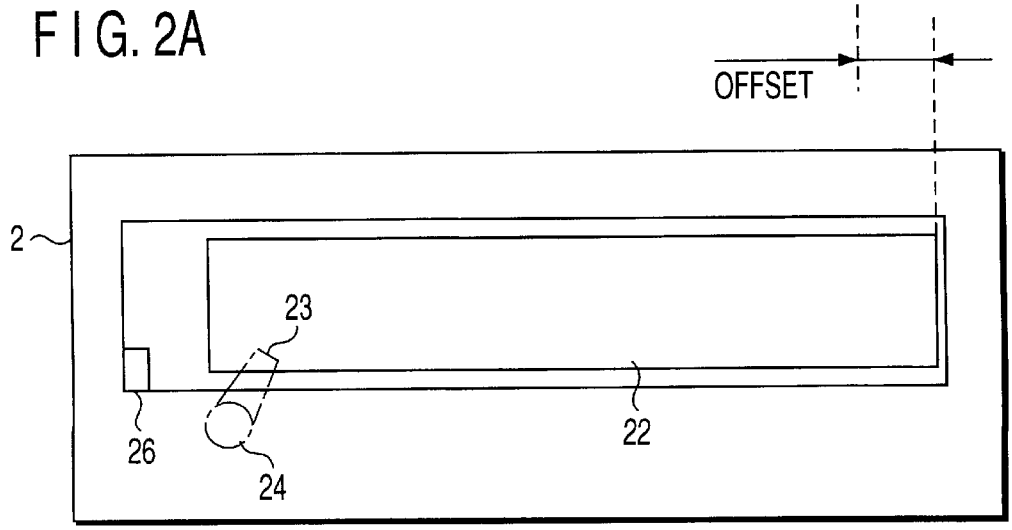

FIG. 1 there is illustrated a schematic of a digital copying machine system embodying the preset invention. FIGS. 2A and 2B are views of the offset stacker in the direction of the arrow A in FIG. 1.

The digital copying machine system is configured such that a digital copying machine 1 is fitted with an offset stacker 2.

The digital copying machine 1 is equipped with an image forming unit 11, discharge rollers 12, and a paper discharge sensor 13.

The image forming unit 11 forms an image on a sheet of paper through a well-known electrophotographic process for example. Paper, after being formed with an image in the image forming unit 11, is transported by a paper transport mechanism to the offset stacker 2 on a paper path W1 formed of guide members, not shown, as shown in FIG. 1. The paper transport mechanism comprises rollers built in to the image forming unit 11 and the discharge rollers 12. The completion of the paper discharge from the digital copying machine 1 to the offset stacker 2 is detected by the paper discharge sensor 13.

The offset stacker 2 includes discharge rollers 21, a moving element 22, an arm 23, an offset motor 24, a timing sensor 25, and an initial position sensor 26.

The paper discharged from the digital copying machine 1 is transported by the discharge rollers 12 to the discharge rollers 21 on a paper path W2 formed of guide members, not shown, as shown in FIG. 1. The paper is then transported by the discharge rollers 21 to a discharge tray 3.

The discharge rollers 21 are held by the moving element 22, which is supported by a supporting structure, not shown, so as to be slidable in a direction that intersects the direction of paper transportation, i.e., in the direction along the axis of the discharge rollers 21. To the moving element 22 is attached an end of the arm 23, the other end of which being fixed to the axis of rotation of the offset motor 24. By rotating the arm 23 by the offset motor 24, the moving element 22 can be set in either of two states as shown in FIGS. 2A and 2B. That is, the moving element 22 can be offset in the direction that intersects the direction of paper transportation, i.e., in the direction along the axis of the discharge rollers 21.

The timing sensor 25, which is positioned upstream of the discharge rollers 21 on the paper path W2, detects the timing of offsetting the moving element 22 by being turned on and off by paper transported on the paper path. The initial position sensor 26 is installed in such a position as shown in FIGS. 2A and 2B and detects that the moving element 22 is placed in the state shown in FIG. 2A by being turned on and off by the moving element 22.

Figure 3:
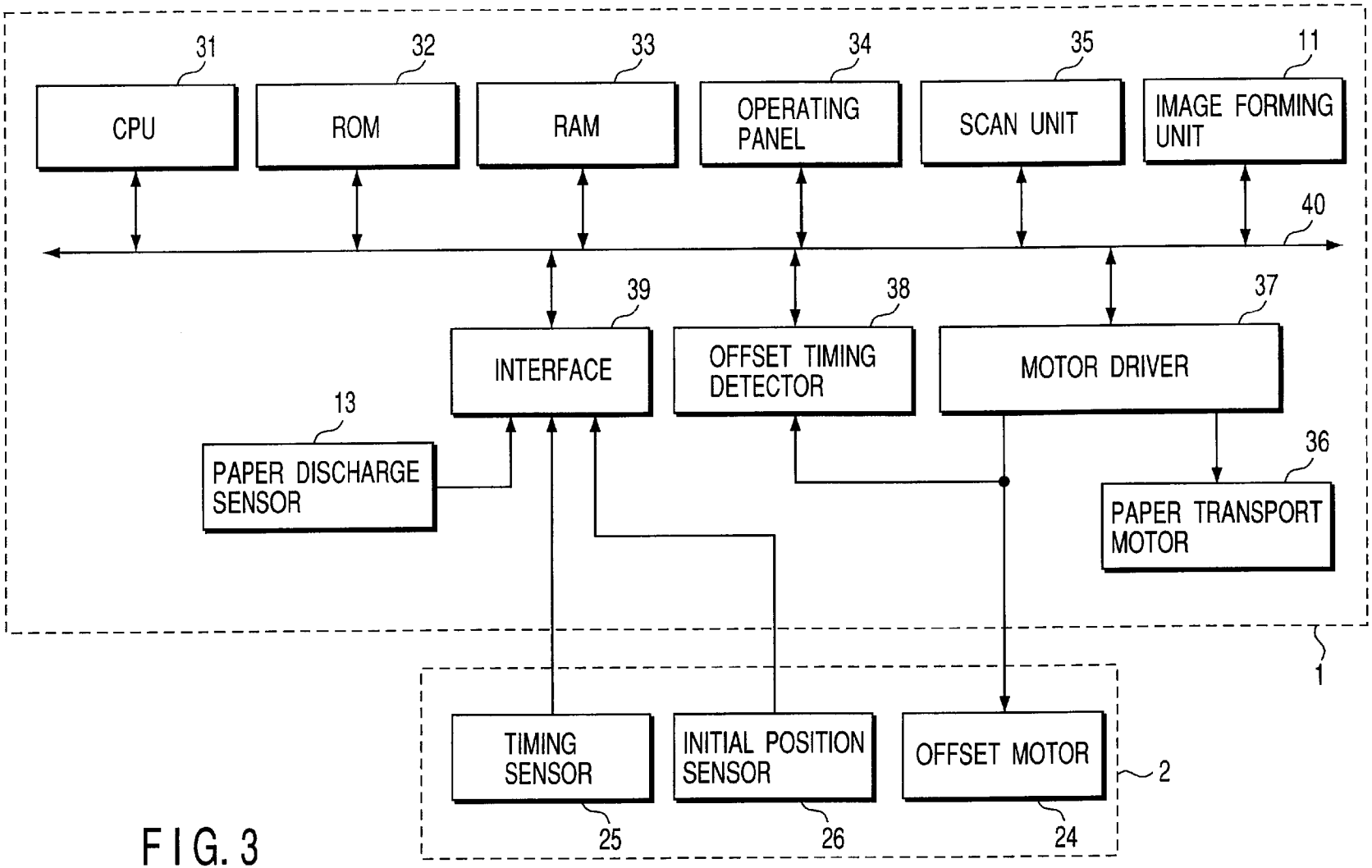
FIG. 3 is a block diagram of an electrical system for the digital copying machine and the offset stacker in FIG. 1.

FIG. 3 is a block diagram of an electrical system for the digital copying machine 1 and the offset stacker 2. In FIG. 3, the corresponding components to those in FIGS. 1, 2A and 2B are denoted by like reference numerals.

As shown in this figure, the digital copying machine 1 includes a CPU 31, a ROM 32, a RAM 33, an operating panel 34, a scan unit 35, a paper transport motor 36, a motor driver 37, an offset timing detector 38, and an interface 39 in addition to the image forming unit 11 and the paper discharge sensor 13.

Of those components, the image forming unit 11, the CPU 31, the ROM 32, the RAM 33, the operating panel 34, the scan unit 35, the motor driver 37, the offset timing detector 38 and the interface 39 are interconnected by a bus 40. To the motor driver 37 are connected the paper transport motor 36 and the offset motor 24. To the interface 39 are connected the paper discharge sensor 13, the initial position sensor 26 and the timing sensor 25.

The CPU 31 carries out various control processes for implementing the operation of the digital copying machine through software processing based on programs stored in the ROM 32. The CPU performs control processing on the offset stacker 2 as well.

The ROM 32 stores processing programs that run on the CPU 31.

The RAM 33 is used to store various pieces of information required for the CPU 31 to carry out various processes.

The operating panel 34 has a key entry unit and a display unit. The key entry unit transfers command inputs to the CPU 31 from the user. The display unit displays various pieces of information to be indicated to the user under the control of the CPU 31.

The scan unit 35 includes an image sensor, image processing circuitry, etc., and scans an original to be copied to produce image data of the original.

The paper transport motor 36 acts as a power source for operating the paper transport mechanism such as rollers in the paper feed mechanism for introducing paper into the image forming unit 11, rollers in the image forming unit 11, the discharge rollers 12, and the paper discharge rollers 21.

The motor driver 37 generates drive signals for operating the offset motor 24 and the paper transport motor 36 under the control of the CPU 31.

The offset timing detector 38 detects the state of a drive signal for the offset motor 24 generated by the motor driver 37 (hereinafter referred to as an offset motor signal) and notifies the CPU 31 of the result.

The interface 39 detects the states of the respective detect signals from the paper discharge sensor 13, the initial position sensor 26, and the timing sensor 25 and notifies the CPU 31 of the results.

The control means implemented by the CPU 31 through software processing based on processing programs stored in the ROM 32 includes offset stacker control means, error detection means, forced stopping means, scan control means, error indication control means, and forced paper discharge means in addition to the well-known standard control means in digital copying machines.

Here, the offset stacker control means controls the timing of driving of the offset motor 24 to allow the offset stacker to provide offset stacking of copies.

The error detection means is responsive to the detected signals from the initial position sensor 26 and the offset timing detector 38 to detect errors in the timing of the offsetting stacking by the offset stacker 2.

The forced stopping means is responsive to the detection of an error in the timing of offset stacking by the error detection means to force an image forming operation in execution to stop.

The scan control means is responsive to the detection of an error in the timing of offset stacking by the error detection means to force an original scanning operation in execution to stop.

The error indication control means causes the operating panel 34 to provide an error indication for notifying the user of the stoppage of the copying operation due to a malfunction of the offset stacker 2. Thus, notification means is implemented by the error indication control means and the operating panel 34.

The forced paper discharge means discharges paper remaining in the machine by force after the forced stoppage of the copying operation in execution by the forced stop means.

The operation of the digital copying machine system thus constructed will be described next.

The various operations for copying an original remain unchanged from those in conventional machines and hence descriptions thereof are omitted here. A description is given here of the offset stacking-related operations.

First, the methods of offset stacking include offsetting every other copy (i.e., each copy is offset from the preceding or succeeding one; offset stacking of alternate copies), offsetting every predetermined number of successive copies (i.e., each set of successive copies is offset from the preceding or succeeding set of successive copies), etc. Here, a description is given of offsetting every other copy, by way of example.

Figure 4:
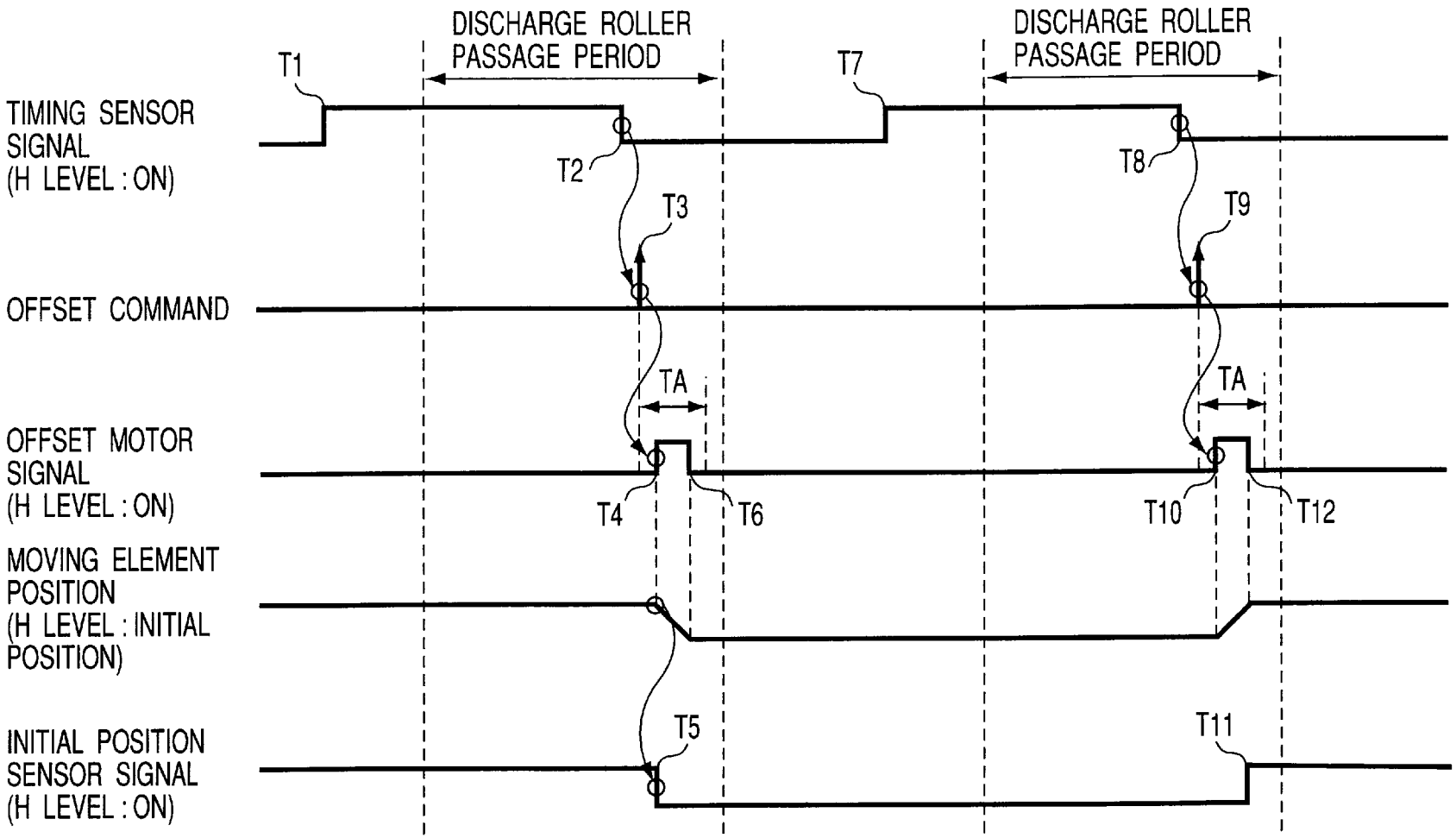
FIG. 4 is a timing diagram illustrating the operation of the offset stacker in FIG. 1.

FIG. 4 shows the timing diagram illustrating the operation of the offset stacker 2 for the offset stacking of alternate copies.

As shown, when a copy is transported from the digital copying machine 1 to the offset stacker 2, the timing sensor 25 is rendered ON (time T1) by that copy. When the copy is further transported, its trailing end moves away from the timing sensor 25, whereupon the sensor is turned OFF (time T2).

At the time when the timing sensor 25 is turned OFF, the end of the copy that is about to fall into the discharge tray 3 is leaving the timing sensor 25 and is therefore away from the discharge rollers 12. Since the end of the copy still does not reach the discharge rollers 21, the copy is pinched by the discharge rollers 21 only. That is, by moving the moving element 22, offset stacking of the copy on the discharge tray 3 is achieved.

After a lapse of a predetermined time from the time T2 when the timing sensor 25 is rendered OFF, the CPU 31 issues an OFFSET command to the motor driver 37 (time T3). The predetermined time is set so that the end of the copy will not pass through discharge rollers 21. Upon receipt of the command, the motor driver 37 turns the offset motor signal ON (HIGH). The offset motor 24 is thereby allowed to start rotating (time T4), which in turn allows the arm 23 to rotate and the moving element 22 to move.

The offset motor 24 has two standby states set; the state prior to the start of rotation and the state after rotation, which is opposite to the state prior to the start of rotation. At the time T1 in FIG. 4, the moving element 22 is placed in its initial position. The offset motor 24 rotates to move the moving element 22 to the position opposite to the initial position. Thus, the moving element 22 leaves its initial position, causing the initial position sensor signal to go OFF (LOW) (time T5).

After that, when a predetermined time elapses which is required to move the moving element 22 to the opposite position, i.e., by a predetermined offset, the motor driver 37 renders the offset motor signal OFF, stopping the rotation of the offset motor 24 (time T6).

Figure 5A:
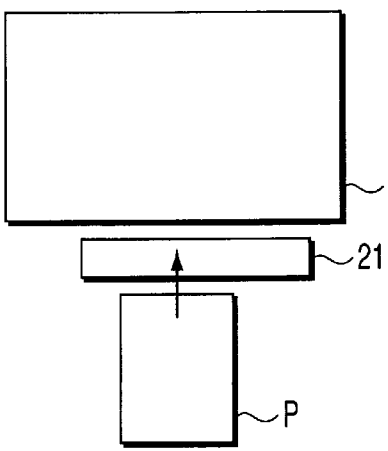
FIGS. 5A–5F illustrate the operation of offsetting sheets of paper.
Figure 5B:
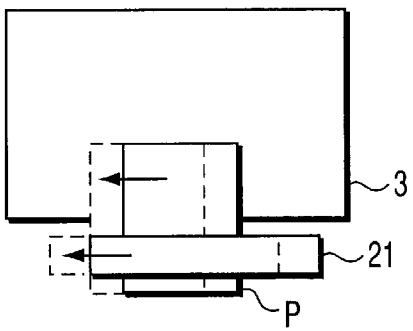

By the above operation, as shown in FIG. 5A, the copy P, which has been transported along the fixed paper path, is fed to the discharge rollers 21 placed in the initial position. When the trailing edge of the copy P becomes pinched by the discharge rollers 21 as shown in FIG. 5B, the rollers are moved to the opposite position indicated by the broken lines. At the same time, the copy P is also moved to the left side in the direction of paper transportation as indicated by the broken lines.

Figure 5C:
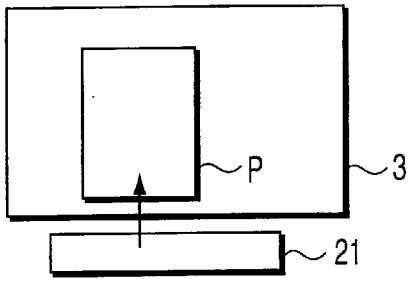

After that, as can bee seen from FIG. 4, the moving element 22 will not move until the copy has passed the discharge rollers. As shown in FIG. 5C, therefore, the copy P will fall into the discharge tray 3 offset to the left, from the centerline of the paper paths W1 and W2.

When the next copy arrives at the timing sensor 25, the timing sensor signal is turned ON (time T7). When the trailing edge of the next copy leaves the timing sensor 35, the timing sensor signal goes OFF (time T8).

After a lapse of a predetermined time from the time T8, the CPU 31 issues an OFFSET command to the motor driver 37 (time T9). Upon receipt of that command, the motor driver 37 renders the offset motor signal ON, thereby allowing the offset motor to start rotating (time T10), which in turn allows the moving element 22 to return to the initial position. Upon return to the initial position, the moving element 22 turns the initial position sensor 26 ON, causing the initial position sensor signal to go ON (time T11). At almost the same time, the offset motor signal is rendered OFF (time T12).

Figure 5D:
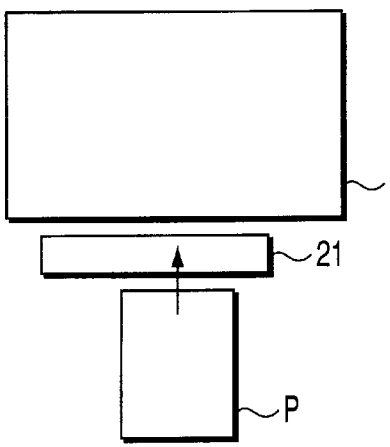
Figure 5E:
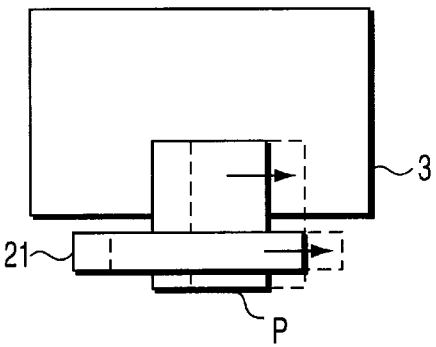

By the above operation, as shown in FIG. 5D, the copy P which has been transported on the fixed paper path is fed to the discharge rollers 21 placed in the opposite position to the initial position. When the trailing edge of the copy P becomes pinched by the discharge rollers 21 as shown in FIG. 5E, the rollers are moved to the initial position indicated by the broken lines. At the same time, the copy P is also moved to the right side in the direction of paper transportation as indicated by the broken lines.

Figure 5F:
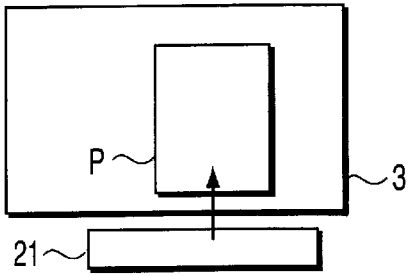

After that, as can bee seen from FIG. 4, the moving element 22 will not move until the copy has passed the discharge rollers. As shown in FIG. 5F, therefore, the copy P will fall into the discharge tray 3 offset to the right, from the centerline of the paper paths W1 and W2.

After that, repeating the above operation allows copies to be offset stacked in the discharge tray 3 on a copy-by-copy basis.

The above operation is performed when the offset stacker 2 works normally. Control processing for the operation is transported out by means of the offset stacker control means in the CPU 31.

Figure 6A:
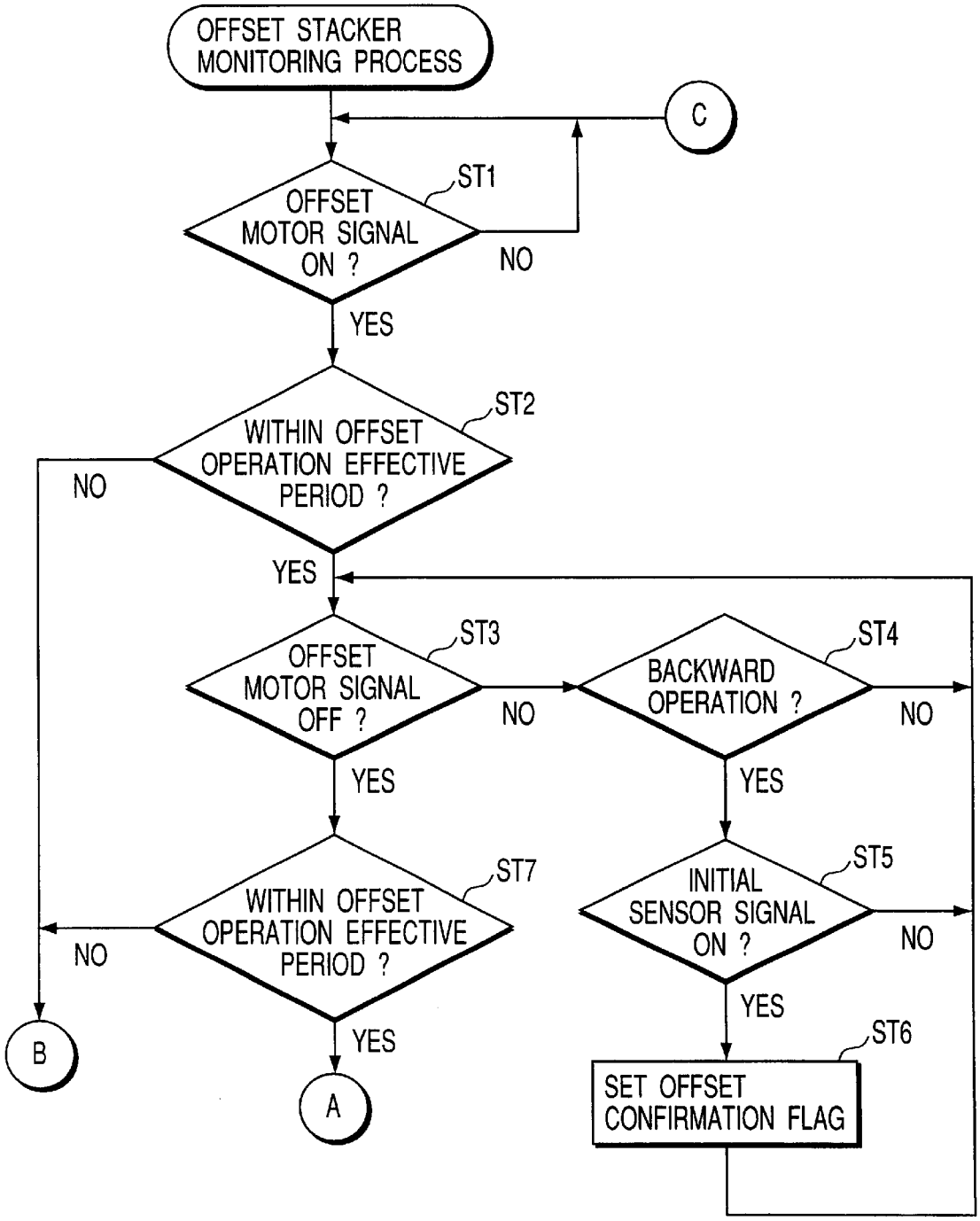
FIGS. 6A and 6B form a flowchart for the offset stacker monitoring process by the CPU in FIG. 1.
Figure 6B:
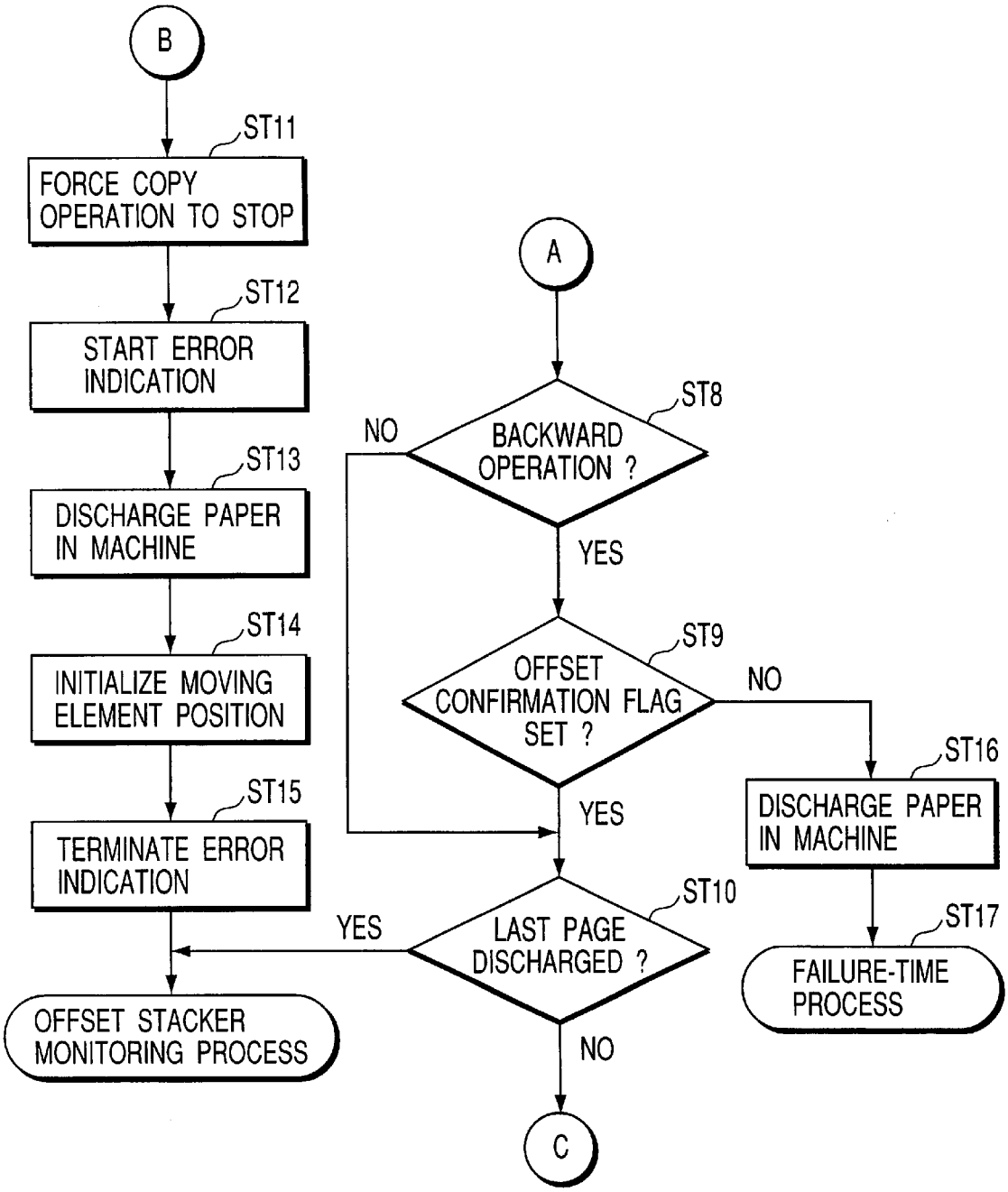

In the CPU 31, concurrently with such a paper discharge operation as described above, offset stacker monitoring processing is transported out by the error detection means, the forced stopping means, and the forced paper discharge means as shown in FIGS. 6A and 6B.

In the offset stacker monitoring processing, the CPU 31 first waits for the offset timing detector 38 to detect that the offset motor signal has gone ON (step ST1). If the offset motor signal has gone ON, the CPU 31 determines whether or not the time at which the signal goes ON is within a predetermined offset operation effective period during which the offset stacking can be performed effectively (step ST2). For example, the offset operation effective period is set to such a period as indicated by TA in FIG. 4 with reference to the time at which the offset command is issued by the offset stacker control means.

If the offset motor signal goes ON within the offset stacking operation effective period as shown in FIG. 4, the offset motor 24 is allowed to start on a timely basis. That is, there is no displacement in the time at which the offset motor 24 is started. In this case, the CPU 31 then monitors the offset motor signal (steps ST3 to ST5). Specifically, when the operation of returning the moving element 22 to the initial position (hereinafter referred to as the backward operation) is being performed, the CPU waits for the offset motor signal to go OFF or the initial position sensor signal to go ON. On the other hand, when the operation of moving the moving element 22 from the initial position to the opposite position (hereinafter referred to as the forward operation) is being performed, the CPU waits only for the offset motor signal to go OFF.

Here, if the backward operation is being performed and each component is working normally, then the initial position sensor signal should have gone ON before the offset motor signal goes OFF. When the CPU 31 confirms in step ST5 that the initial position sensor signal has gone ON, the CPU sets the offset confirmation flag (step ST6) to indicate that the moving element 22 has been moved normally. After that, the CPU 31 returns to the wait state in steps ST3 to ST5.

If, when the CPU is placed in the wait state, the offset motor signal goes OFF, the CPU determines whether or not the time when that signal has gone OFF is within the offset operation effective period (step ST7).

If the offset motor signal goes OFF within the offset stacking operation effective period, the offset motor 24 is allowed to stop on a timely basis as shown in FIG. 4. That is, there is no displacement in the time at which the offset motor 24 is stopped. The offset motor signal is rendered ON at the correct time and then held ON during for the correct period as shown in FIG. 4. It can therefore be determined that the timing of the motor offset signal is normal. In this case, the CPU 31 then determines whether or not the operation terminated by stoppage of the offset motor 24 is the backward operation (step ST8). In the case of the backward operation only, the CPU 31 then determines whether or not the offset flag has been set (step ST9).

If the moving element 22 is working normally in the backward operation, the initial position sensor signal is expected to go ON during the backward operation. That is, the CPU 31 should have set the offset confirmation flag in step ST6. Thus, that the offset confirmation flag is set indicates that the moving element is working normally.

When the operation is not the backward operation, the moving element 22 is considered to be working normally without making a check for its operation in step ST9.

Under the conditions that both the timing of the offset motor signal and the operation of the moving element 22 are determined to be normal, the CPU 31 determines whether or not the copy discharged at this time is the last page (step ST10). If so, the offset stacker monitoring processing is terminated; otherwise, the processing is repeated, starting with step ST1 to monitor the operation of the offset stacker 2 for discharge of the subsequent page or pages.

If the offset motor signal does not go ON or OFF within the offset stacking effective period due to, for example, a malfunction of the motor driver 37 or noise mixed in the offset motor signal, the CPU 31 detects it in step ST2 or ST7. In this case, the CPU 31 immediately forces all the copying operations, i.e., the image scanning, image formation, and paper discharge, to stop (step ST11) and then causes the operating panel 34 to provide an error indication for notifying the user of the stoppage of the copying operation due to the malfunction of the offset stacker 2 (step ST12).

Subsequently, the CPU 31 performs a paper discharge process to discharge residual paper in the machine (step ST13). In this in-machine paper discharge process, only the paper transporting motor 36 is driven to transport paper, without operating the image forming unit 11 and the offset motor 24.

If the discharge of residual paper is complete, then the CPU 31 initializes the position of the moving element 22 (step ST14). In this initialization process, when the initial position sensor signal is OFF, the backward operation is performed until the initial position sensor signal goes ON. If, on the other hand, the initial position sensor signal is ON, the forward operation is first performed until the initial position sensor signal goes OFF and the backward operation is then performed until the initial position sensor signal goes ON.

The above initialization process sets the apparatus in the initial state in which it can start normal operation. Thus, the CPU 31 terminates the error indication (step ST15) and then returns the apparatus to the wait state in which it is ready to perform the next copy operation.

On the other hand, if it is found in step ST9 that the offset confirmation flag is not set, i.e., if the moving element 22 has not moved to the initial position regardless of the backward operation, then the CPU 31 performs the in-machine paper discharge process as in step ST13 (step ST16). In that case, it is supposed that some failure has occurred in the equipment; thus, the CPU 31 goes to a predetermined failure-time process (step ST17). For example, the failure-time process is to inhibit the subsequent copy operation and indicate a service call. In this case, the apparatus may be made ready for copying on condition that no use is made of the offset stacker 2. In that case, because the offset stacker is not used, in performing a copy operation the service call may be temporarily cancelled, or indicated successively, if there is room to display it. However, when the service call indication is stopped temporarily, it is advisable to provide the service call indication again when a request is made to use the offset stacker 2.

According to the present embodiment, as described above, the operational state of the offset stacker 2 is monitored and copy processing is stopped immediately on the occurrence of a displacement in the timing of the offset motor signal or a malfunction of the moving element 22. This allows prevents the occurrence of a paper jam in which paper becomes wedged or damaged. within the machine.

Moreover, according to the present invention, by preventing the occurrence of paper jams, residual paper in the machine can be placed in a transportable state. The residual paper can therefore be discharged automatically with the moving element 22 being inoperative. This eliminates the need for the user to remove the residual paper manually. Also, the components can be prevented from accidental damage by the user.

The present invention is not limited to the above embodiment. For example, although, in the embodiment, the operating state of the offset stacker 2 is monitored based both on the displacements in the timing of the offset motor signal and malfunctions of the moving element 22, only one of them may be used. Alternatively, a circuit that diagnoses the state of the offset motor 24 may be provided. Any method of. monitoring the operating state of the offset stacker 2 may be used.

In the embodiment, only the initial position sensor 26 is used to determine whether the moving element 2 is moving normally, another sensor may be provided in the position opposite to the initial position, to check for movement of the moving element in the forward operation.

In the above embodiment, on occurrence of an offset stacker malfunction, the copy operation is temporarily stopped and residual paper in the machine is automatically discharged; however, automatic paper discharge need not necessarily be performed. In this case, residual paper is removed by the user. Since the paper is not jammed in the machine, it is easy for the user to remove it from the machine and there is little increase of the burden on the user. Alternatively, automatic paper discharge may be performed not unconditionally as in the above embodiment, but on some conditions, that is, for example, paper may be discharged upon reception of such an instruction from the user.

Furthermore, in the embodiment, copies are offset by moving the paper discharge rollers 21; instead of moving the rollers, the paper discharge tray 3 may be moved.

In addition, although the embodiment is configured to provide a visual error indication to notify the user of the stoppage of copy operation due to a malfunction of the offset stacker 2, an audible indication may be provided instead.

Although the present invention has been described in terms of a digital copying machine, the principles of the invention are equally applicable to a facsimile machine or a printer.

The present invention may be practiced or embodied in still other ways without departing from the scope and sprit thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which forms images on recording sheets transported by a transport mechanism on a predetermined path using an image forming device, and which can be fitted with an offset stacker that, in discharging the sheets into a discharge tray, offset stacks the sheets in the discharge tray, said image forming apparatus comprising:

error detection means for detecting an error in a timing of offset stacking by the offset stacker; and forced stopping means for forcing a stop in operation of the transport mechanism and the image forming device when the error detection means outputs an error detection signal.

2. The image forming apparatus according to claim 1, wherein the offset stacker is equipped with discharge rollers that allow the sheets to be discharged into the discharge tray, and wherein the discharge rollers are adapted to pinch the sheets and be moved in a direction that intersects a direction in which the sheets are discharged to thereby offset a position in which the sheets are discharged.

3. The image forming apparatus according to claim 1, further comprising forced discharge means for causing the transport mechanism to operate in a state where the offset stacker is made inoperative after the operation of the transport mechanism and the image forming device has been stopped by the forced stopping means.

4. The image forming apparatus according to claim 1, further comprising indication means for, when the operation of the transport mechanism and the image forming device is being stopped by the forced stopping means, providing an indication to that effect.

5. A copying machine which includes an image scanner for scanning images on original sheets and an image forming apparatus for forming the images scanned by the image scanner on recording sheets transported by a transport mechanism on a predetermined path using an image forming device, wherein said image forming apparatus is adapted to be fitted with an offset stacker that, in discharging the recording sheets into a discharge tray, offset stacks the recording sheets in the discharge tray, said copying machine comprising:

error detection means for detecting an error in a timing of offset stacking by the offset stacker; and forced stopping means for forcing a stop in operation of the transport mechanism and the image forming device when the error detection means outputs an error detection signal.

6. The image forming apparatus according to claim 5, further comprising scan control means for stopping operation of the image scanner when the error detection means outputs the error detection signal.

7. A method of controlling an image forming apparatus which forms images on recording sheets transported by a transport mechanism on a predetermined path using an image forming device, and which can be fitted with an offset stacker that, in discharging the sheets into a discharge tray, offset stacks the sheets in the discharge tray, said image forming apparatus comprising:

detecting an error in a timing of offset stacking by the offset stacker; and forcing a stop in operation of the transport mechanism and the image forming device when the error in the timing of offset stacking is detected.

8. An image forming system comprising:

(i) an image forming apparatus which forms images on recording sheets, and which includes a first conveying path that conveys the sheets;

(ii) an offset stacker connected with the image forming apparatus, said offset stacker including:

a second conveying path, downstream of the first conveying path, that further conveys the sheets;

a discharge roller, provided at an end portion of the second conveying path, that discharges the sheets while the sheets are shifted in a direction intersecting perpendicularly with a conveying direction of the sheets;

a discharge tray that receives the sheets discharged from the discharge roller in a shifted state; and a sensor disposed in the second conveying path for sensing a timing error in shifting of the sheets by the discharge roller; and (iii) a controller which controls conveying of the sheets on the first and second conveying paths to be stopped when the sensor senses the timing error.

9. The image forming system according to claim 8, wherein the sheets are nipped by the discharge roller only after the sheets have passed the sensor.

10. The image forming system according to claim 8, wherein the discharge roller moves in the direction intersecting perpendicularly with the conveying direction of the sheets after the sheets have passed the sensor.

11. The image forming system according to claim 8, wherein the controller forcibly stops operation of an image forming device provided in the image forming apparatus when the controller controls the conveying of the sheets on the first and second conveying paths to be stopped.

12. The image forming system according to claim 11, wherein the controller restarts conveying of the sheets on the first and second conveying paths when the operation of the image forming device has been stopped.

13. The image forming system according to claim 8, further comprising a display which, when the controller has controlled the conveying of the sheets on the first and second conveying paths to be stopped, makes a display providing an indication that the conveying of the sheets on the first and second conveying paths has been stopped.

14. The image forming system according to claim 8, wherein the image forming apparatus operates according to an electrophotographic method.

15. The image forming system according to claim 8, further comprising a scanner that scans images on original sheets.

16. The image forming system according to claim 15, wherein the controller forcibly stops operation of image scanning by the scanner when the controller controls the conveying of the sheets on the first and second conveying paths to be stopped.

* * * * *